US007485591B2

(12) United States Patent
Frey et al.

(10) Patent No.: US 7,485,591 B2
(45) Date of Patent: Feb. 3, 2009

(54) ELECTROSPUN NANOFIBER-BASED BIOSENSOR ASSEMBLIES

(75) Inventors: Margaret W. Frey, Ithaca, NY (US); Antje J. Baeumner, Ithaca, NY (US); Dapeng Li, Ithaca, NY (US); Prashant Kakad, Hillsboro, OR (US)

(73) Assignee: Cornell Research Foundation, Inc., Ithaca, NY (US)

( * ) Notice: Subject to any disclaimer, the term of this patent is extended or adjusted under 35 U.S.C. 154(b) by 138 days.

(21) Appl. No.: 11/417,188

(22) Filed: May 4, 2006

(65) Prior Publication Data

US 2006/0260707 A1 Nov. 23, 2006

Related U.S. Application Data

(60) Provisional application No. 60/683,345, filed on May 23, 2005.

(51) Int. Cl.
*D04H 13/00* (2006.01)

(52) U.S. Cl. ..... 442/340; 428/375; 442/330; 442/334; 442/351; 138/140

(58) Field of Classification Search ..... 428/903, 428/361, 376, 375; 442/330, 334, 340, 351; 138/140, 141, 149
See application file for complete search history.

(56) References Cited

U.S. PATENT DOCUMENTS

2006/0094320 A1* 5/2006 Chen et al. ..... 442/340

OTHER PUBLICATIONS

Baeumner, A., et al, "Nanofiber-Based Biosensors", poster presented May 23 and May 24, 2005 at Cornell Center for Materials Research Polymer Outreach Program (POP) Symposium.

* cited by examiner

*Primary Examiner*—Arti Singh
(74) *Attorney, Agent, or Firm*—Bacon & Thomas, PLLC

(57) ABSTRACT

Electrospun nanofiber incorporating a binder (e.g., biotin) is used in the form of a nonwoven or composite with a substrate. The nonwoven and composite can be joined to biosensor, e.g., by binding the biotin to streptavidin and binding streptavidin to biotinylated detector, and because of the high surface area to volume of electrospun nanofiber provides increased sensitivity.

15 Claims, No Drawings

ELECTROSPUN NANOFIBER-BASED BIOSENSOR ASSEMBLIES

CROSS-REFERENCE TO RELATED APPLICATIONS

This application claims the benefit of U.S. Provisional patent Application No. 60/683,345, filed May 23, 2005, the whole of which is incorporated herein by reference.

TECHNICAL FIELD

This invention is directed at biosensor assemblies.

BACKGROUND OF THE INVENTION

Biorecognition molecules are known as a mechanism for detection. Tagging these biorecognition molecules with biotin is a known mechanism for the immobilization onto a surface via specific biotin-streptavidin binding. Studies are being carried out on how to increase the sensitivity of the biosensors; these studies involve introducing signal amplification mechanism. Limited studies have heretofore been carried out on increasing sensitivity by replacing the conventional membrane substrate with a higher surface area membrane substrate or by providing a coating or layer of higher surface area over all or a portion of a conventional membrane substrate.

SUMMARY OF THE INVENTION

It has been discovered herein that increased biosensor sensitivity is obtained by associating the biosensor with membrane, coating or layer from electrospun nanofiber. The high surface area of the nanofibers provides significantly more biosensor sites for target or analyte to bind to, to be detected by an analysis method; the significantly more biosensor sites (e.g., $1\times10^2$-$7\times10^{12}$ times more binding sites per square cm) provide increased sensitivity.

In one embodiment of the invention herein, denoted the first embodiment, there is provided for attachment of biosensing molecule thereto a nonwoven fabric from or composite of part or all of a substrate and, electrospun thermoplastic polymer nanofiber incorporating a first binder that specifically binds to one of a plurality of specific binding sites of a second binder where the other sites are capable of binding to a third binder which will specifically bind to a target.

In another embodiment of the invention herein, denoted the second embodiment, the invention is directed at nonwoven fabric from or composite of a substrate and, electrospun thermoplastic polymer nanofiber associated with a biosensor.

In another embodiment of the invention herein, denoted the third embodiment, the invention is directed at a nonwoven fabric from or a composite of part or all of a substrate and, electrospun thermoplastic polymer having biotin incorporated therein in an amount ranging from 1% to 20% by weight of the thermoplastic polymer.

In another embodiment herein, denoted the fourth embodiment, the invention is directed at a non-woven fabric from or a composite of part or all of a substrate and, electrospun thermoplastic polymer nanofiber having biotin incorporated therein in an amount ranging from 1% to 20% by weight of the thermoplastic polymer, said biotin being bound to avidin or streptavidin, or having streptavidin incorporated therein (without associated biotin) in an amount ranging from 1% to 20% by weight of the thermoplastic polymer.

DETAILED DESCRIPTION

The electrospun thermoplastic polymer nanofiber incorporating a first binder can be made by solution electrospinning a solution of thermoplastic polymer and first binder or by melt electrospinning a melt of thermoplastic polymer with first binder compounded therein.

The term "polymer" as used in the above paragraph includes monopolymers as well as copolymers.

The thermoplastic polymers include for example, cellulose acetate, polyacrylonitrile, polyethylene oxide, polyvinylalcohol, polyamides, for example, Nylon-6, Nylon-6,6 and poly (p-phenylene terephthalamide), polyesters, e.g., poly (lactic acid), polyethylene terephthalate and polytrimethylane terephthalate, polycarbonate, polyurethane including polyester urethane and polyether urethane, and polyethylene vinyl acetate. A polymer used in experiments in the development of the invention is polylactic acid ($M_n$=186,000, PDI of 1.76) obtainable from Cargill Dow (Minnetonka, Minn.). (PLA)

The first binder can be for example, a multifunctional molecule of molecular weight ranging from 200 to 500, for example, biotin, fluorescein or digoxygenin. It is normally incorporated in the electrospun thermoplastic polymer nanofiber in an amount ranging from 1% to 20% by weight of the thermoplastic polymer. A preferred first binder is biotin.

For solution electrospinning, the biotin is readily associated with polymer by dissolving biotin and polymer in solution. A solvent for biotin and PLA is chloroform/acetone solvent (3:1 volume ratio). Other solvents have been used. Preferably a selected amount of biotin is added to mixed solvent and the mixture is ultrasonicated for 60 minutes to obtain a uniform dispersion. Then PLA pellets are added and complete dissolution is obtained. In the experiment herein ultrasonication was carried out for another 60 minutes before electrospinning. Suspending biotin in a polymer solution is also possible.

For melt electrospinning the polymer is heated to form a melt at a temperature where the first binder dissolves in the melt.

Electrospinning apparatus used in experiments herein consisted of a gamma high voltage source capable of delivering up to about 30 kV and a Harvard apparatus dual syringe pump with needle providing electrospinning orifice.

In either case, i.e., solution or melt electrospinning, the collector is of opposite polarity from that imparted to the formed nanofiber or grounded. For forming a composite, the electrospinning apparatus is preferably associated with a suitable roll-to-roll processing stand for carrying a substrate in front of the collector for deposit of electrospun fibers thereon.

Electrospinning apparatus for solution electrospinning is schematically depicted in Subbiah, T., et al., "Electrospinning of nanofibers", Journal of Applied Polymer Science 96(2), 557-596 (2005).

Electrospinning apparatus for melt electrospinning is schematically depicted in Joo, Y. L., et al., Patent Publication No. US-2005-0287239-A1 published Dec. 29, 2005.

The electrospinning is carried out, for example, at a voltage ranging from 1 to 50 kV, a feed rate ranging from 2 to 0.1 microliters per minute and a electrospinning orifice to collector distance ranging from 2 to 30 cms.

In experiments carried out, PLA in solution as described above with biotin dissolved therein was processed by solution electrospinning. The concentration of PLA in solution was 8% by weight and biotin was included at 1 to 3% by weight relative to the PLA and electrospinning was carried out at a voltage of 15 kV, a feed rate of 0.41 μL/min, a needle orifice size of 0.41 mm and a collector distance from needle orifice of 12 cm. In the experiments herein, the inclusion of biotin in amount up to 3% by weight relative to PLA did not make a significant difference in fiber size and uniformity.

We turn now to the case of nonwoven fabric from electrospun thermoplastic polymer nanofiber incorporating a first binder that specifically binds to one of a plurality of specific binding sites of a second binder where the other sites of the plurality of specific binder sites are capable of binding to a third binder which will specifically bind to a target.

The nanofiber can have an average diameter ranging from 50 nanometers to 5 microns. In the experiments described above, average diameters obtained were 100 nanometers to 3 microns. Average diameter can be varied by changing electrospinning conditions as follows: Increasing electrospinning voltage decreases average nanofiber diameter. Increasing feed rate to electrospinning orifice increases average nanofiber diameter. Increasing polymer concentration in the spinning solution increases fiber diameter.

The nanofiber length to mass ratio for a PLA nanofiber (density =1.248 g/cc) can range from 226000:1 m/gram (1 gram of a 5 micron diameter PLA fiber) to 226,000,000:1 m/g (1 gm of 50 nm diameter PLA fiber). In the electrospinning experiments carried out, the length of the fibers was considered to be continuous for the duration of the electrospinning since no ends were noted in photomicrographs.

The formed nonwoven/mat needs to transport fluids through the pores and capture target analytes on fiber surfaces surrounding the pores. Thus pore size cannot be so small that analytes and liposomes (liposomes are about 300 nm in diameter and are important for signal generation and amplification; they include a binding element to bind to the analyte) are excluded before they reach the detection sites. On the other hand, large surface area to volume is important to obtain the advantage that is an object of the invention of increased biosensor sensitivity. The nonwoven/mat can have average pore size, for example, ranging from 0.1 to 15 microns. In the electrospinning experiments carried out, average pore sizes obtained were 0.8 to 18 microns; these corresponded to surface area to volume ratios of 800,000 to 8,000 $cm^{-1}$($cm^2$/$cm^3$). The fiber length has been found to be the most important factor determining pore size and pore size distribution in the nonwoven/mat. As fiber length is increased, pore size is decreased.

We turn now to the case of composite of part of all of a substrate and electrospun thermoplastic polymer nanofiber incorporating a first binder that specifically binds to one of a plurality of specific binder sites of a second binder where the other sites of the plurality of specific binder sites are capable of binder to a third binder which will specifically bind to a target.

In this case the nanofiber is used specifically for sensor/detection function while other properties such as physical strength, aesthetics, absorbency, handleability, and economic advantage are provided by the substrate.

The substrate can be constituted, for example, of cellulose, e.g., in the form of paper (e.g., absorbent paper) or cotton; or other cellulosics such as rayon (regenerated cellulose), cellulose acetate, cellulose triacetate. It can be, for example, a disposable wipe, or other wiping cloth, a paper towel, a cotton swab, porous media (e.g., expanded PTFE film (GORE-TEX®) or microporous polyurethane barrier film), a nonwoven (e.g., of polyethylene or polypropylene (TYVEK®), cleaning cloths, or dust cloths (SWIFFER®, HANDWIPES®), a woven (e.g., of plain weave fabric), a knit textile (e.g., of jersey knit fabric), a film (e.g., of polyether sulfone, polyester, polyethylene wrapping/packaging film (e.g., SARAN WRAP®), a functional solid surface, e.g. surface plasoman resonance chip, a silicon chip to immobilize certain components of a fluid system to remove them from the fluid as other components are being analyzed or to hold analyte while other functions on chip is occurring, or a packaging application polymer film, e.g., to provide a sensor within a packaging application that would change color if package contents become contaminated; a larger fiber or fiber assembly, e.g., constituted of carbon fibers, copper strands, or conventional textile fiber, yarn or tow made of cotton, nylon, wool, polypropylene, polyethylene, polyester, KEVLAR®, nomex, or other polymeric material for use as a component in a larger textile structure produced via normal textile production methods including nonwoven batt formation, yarn spinning, weaving or knitting; or presently used conventional fabric or membrane.

In one case, the electrospun portion can be a dime-sized spot constituted of e.g., 1 km length electrospun sensor nanofiber on one corner of a substrate.

The electrospun nanofiber can be applied directly on or into a substrate during electrospinning by placing the substrate in front of collection surface that is grounded or of opposite polarity.

Alternatively, a nonwoven or mat or membrane can be formed separately and all or part (all cut up or otherwise divided) joined to substrate as a coating or layer.

We turn now to electrospinning directly onto a substrate.

It is possible to electrospin a small spot on a substrate, e.g., a dime sized spot on a substrate; this can be done using a single electrospinning spinneret and a grounded (or opposite charged) electrode shaped like the desired spot positioned just behind the substrate. The weight of the spot can range for example from 0.00001 to 1 gram; the low limit is the weight of 250 meters of 200 nm diameter fiber.

It is also possible to electrospin directly onto a larger fiber or fiber assembly (e.g., constituted of conducting yams such as copper strands or carbon fiber yams, or monofilaments, e.g., constituted of polyester, nylon or polypropylene) or a tow, yam or other bundle of fibers. This can be carried out, for example, by reeling a larger fiber, tow, yam or other bundle of fibers past the electrospinning collection electrode. Fibers carrying electrospun fibers can be incorporated into or onto conventional textile structures via incorporation in nonwoven batts, spinning into yams or threads, weaving, knitting or embroidering onto a surface.

It is also possible to electrospin directly into a liquid substrate. In this case the liquid itself is grounded to form the collecting electrode. Electrospun fibers suspended in liquid optionally containing suspended conventional fibers, can be incorporated into wet laid nonwovens or applied to other fabrics (nonwoven or otherwise) from suspension in the liquid; this tends to mingle the nanofibers into the structure of the nonwoven or fabric between and among conventional fibers and yams.

We turn now to the case of the nanofibers on a cotton swab. This can be accomplished by placing the swab in front of the collection ground for spinning onto the swab or spinning can be carried out onto cotton batting passing in front of the collection ground before applying the batting to a stick to make a swab.

We turn now to the cases where electrospinning is carried out to make a nonwoven or membrane or mat which is used whole or which is cut up or otherwise divided for attachment as a coating or layer on a substrate. The nonwoven or portion of nonwoven can be attached to substrate, for example, using an adhesive, by solvent binding (applying small amount of a solvent for electrospun and substrate layers to all of the surfaces to be joined or corresponding portions thereof and placing the surfaces to be joined in contiguity to cause the bonding), needle punching, hydroentangling, melt bonding (melting electrospun and substrate layers at corresponding locations for bonding), sewing or quilting.

In the case of the silicon chip mentioned above, or the packaging application film, nanofiber layer can be adhered using an adhesive.

In the case of composites, the nanofiber directly electrospun or used in the form of nonwoven or part thereof, has average fiber diameter and length as described above and is used in assembly with pore size as described above.

The second binder is joined to nanofiber incorporating first binder, for example, by simple incubation with the fiber, by incubation at varying temperatures, e.g., at a temperature ranging from 0° to 98° C., or by shaking or mixing during an incubation period.

We turn now to the second binder. It should be such that the association constant for covalent bonding ranges, for example, from $10^{-3}$ $M^{-1}$ to $10^{-20}$ $M^{-1}$.

The second binder can be, for example, avidin/streptividin, antibody, receptor, protein A, protein G, other protein, DNA and RNA molecules, PNA (peptide nucleic acid), enzyme or lectin. The association constant between biotin and avidin is $10^{-15}$ $M^{-1}$. The association constant for streptavidin binding to biotin is $10^{-16}$ $M^{-1}$.

Alternatively, as indicated above, the combination of the first and second binder can be replaced by incorporation into the electrospun thermoplastic polymer nanofiber, of streptavidin. This can be carried out by including streptavidin in the electrospinning solution dissolved in aqueous solvent.

The third binder is preferably biotinylated for attachment to streptavidin or avidin second binder and can be, for example, antibody, antigen, DNA or other molecule, including reporter probe, e.g., oligonucleotide probe or antivirus or DNA or RNA sequences, that hybridizes with target.

The third binder is joined to the second binder by simple incubation with the fiber, by incubation at a temperature ranging from 0 to 98° C. or by shaking or mixing during an incubation period.

The biorecognition element for the second embodiment can be the third binder.

The third and fourth embodiments are described as part of the first embodiment.

Variations

The foregoing description of the invention has been presented describing certain operable and preferred embodiments. It is not intended that the invention should be so limited since variations and modifications thereof will be obvious to those skilled in the art, all of which are within the spirit and scope of the invention.

What is claimed is:

1. A nonwoven fabric from electrospun thermoplastic nanofiber or a composite of a substrate and electrospun thermoplastic nanofiber, wherein said electrospun thermoplastic nanofiber incorporates a first binder that specifically binds to one of a plurality of specific binding sites of a second binder where the other sites are capable of binding to a third binder that will specifically bind to a target, where the first binder is specifically bound to said second binder.

2. The nonwoven fabric or the composite of claim 1 where the second binder is selected from the group consisting of streptavidin and avidin.

3. The non-woven fabric or the composite of claim 1 where streptavidin is substituted for first binder specifically bound to a second binder.

4. The nonwoven fabric or the composite of claim 1 wherein said first binder is biotin.

5. The nonwoven fabric or the composite of claim 1 wherein said second binder is specifically bound to said third binder.

6. The nonwoven fabric or the composite of claim 1 which is a nonwoven fabric.

7. The nonwoven fabric or the composite of claim 1 where the association constant for covalent bonding of the second binder ranges from $10^{-3}M^{-1}$ to $10^{-20}M^{-1}$.

8. A nonwoven fabric from electrospun thermoplastic nanofiber or a composite of a substrate and electrospun thermoplastic nanofiber, wherein said electrospun thermoplastic polymer nanofiber is associated with a biorecognition element which is selected from the group consisting of biotinylated antibody, biotinylated antigen, and biotinylated molecule that hybridizes with target.

9. A nonwoven fabric from electrospun thermoplastic nanofiber or a composite of a substrate and electrospun thermoplastic nanofiber, where said electrospun thermoplastic polymer nanofiber is associated with a biorecognition element where the biorecognition element is biotinylated and the biotinylated biorecognition element is bound to streptavidin which is bound to biotin incorporated in the nanofiber.

10. A nonwoven fabric from electrospun thermoplastic nanofiber or a composite of a substrate and electrospun thermoplastic nanofiber, wherein said electrospun thermoplastic fiber has biotin incorporated therein in an amount ranging from 1% to 20% by weight of the thermoplastic polymer, said biotin being bound to avidin or streptavidin.

11. The nonwoven fabric or the composite of claim 10 wherein said avidin or streptavidin is also bound to a third binder which will specifically bind to a target.

12. The nonwoven fabric or the composite of claim 11 wherein said third binder is biotinylated.

13. The nonwoven fabric or the composite of claim 10 where a biotinylated composition is bound to said avidin or streptavidin.

14. The nonwoven fabric or the composite of claim 13 wherein said biotinylated composition is a biorecognition element.

15. A nonwoven fabric from electrospun thermoplastic nanofiber or a composite of a substrate and an electrospun thermoplastic nanofiber, comprising an electrospun thermoplastic polymer nanofiber incorporating a first binder, a second binder bound to said first binder, and a third binder bound to said second binder, wherein said first binder specifically binds to one of a plurality of specific binding sites of a second binder, and wherein other sites of said second binder are capable of binding to the third binder, and wherein said third binder will specifically bind to a target.

* * * * *